US011209253B2

(12) United States Patent
Birner et al.

(10) Patent No.: US 11,209,253 B2
(45) Date of Patent: Dec. 28, 2021

(54) ARROW WITH STABILIZING DEFLECTOR

(71) Applicant: MCP IP, LLC, Sparta, WI (US)

(72) Inventors: Jamie L. Birner, Warrens, WI (US); Mathew A. McPherson, Norwalk, WI (US); John R. Scovil, Onalaska, WI (US); Mark J. Hayes, Sparta, WI (US); Jeffrey A. Ozanne, La Crosse, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 16/548,678

(22) Filed: Aug. 22, 2019

(65) Prior Publication Data

US 2020/0064109 A1 Feb. 27, 2020

Related U.S. Application Data

(60) Provisional application No. 62/721,301, filed on Aug. 22, 2018.

(51) Int. Cl.
*F42B 6/06* (2006.01)

(52) U.S. Cl.
CPC ..... *F42B 6/06* (2013.01)

(58) Field of Classification Search
CPC .... F42B 6/04; F42B 6/06; F42B 10/00; F42B 10/02
USPC ..... 473/578, 585, 586
See application file for complete search history.

(56) References Cited

U.S. PATENT DOCUMENTS 1,424,672 A 8/1922 Ogrissek
3,746,334 A * 7/1973 Stubblefield ..... A63B 65/02 482/20
3,815,916 A * 6/1974 Meszaros ..... F42B 6/06 473/586
3,903,639 A 9/1975 Howell
3,946,519 A 3/1976 Vadik et al.
4,182,513 A * 1/1980 Henderson ..... F42B 6/04 124/24.1
4,204,307 A * 5/1980 Pfetzing ..... F42B 6/06 29/407.09
4,254,958 A * 3/1981 Bateman, III ..... F42B 6/08 473/583
4,380,340 A * 4/1983 Simo ..... F42B 6/04 473/577
4,463,953 A * 8/1984 Jordan ..... F42B 12/54 473/581
4,534,568 A * 8/1985 Tone ..... F42B 6/04 403/164
4,589,778 A 5/1986 Mitchell
4,905,397 A * 3/1990 Juelg, Jr. ..... F42B 6/04 43/6
5,234,220 A * 8/1993 Schellhammer ..... F42B 6/04 156/180
5,306,020 A * 4/1994 Bolf ..... F42B 6/06 473/578
5,311,855 A 5/1994 Basik
(Continued)

*Primary Examiner* — Alexander R Niconovich
(74) *Attorney, Agent, or Firm* — Laabs Intellectual Property

(57) ABSTRACT

In some embodiments, an arrow comprises a shaft, a nock and a deflector. The shaft comprises a cavity and the nock comprises a boss. The deflector surrounds the shaft and comprises a deflecting surface oriented at an angle to a surface of the shaft. The boss is positioned within the cavity and the deflector overlaps the boss.

20 Claims, 23 Drawing Sheets

(56) References Cited

U.S. PATENT DOCUMENTS 5,439,231 A 8/1995 Roberts et al.
5,496,041 A 3/1996 Broussard
5,846,147 A * 12/1998 Basik ..... F42B 10/12 473/586
5,863,250 A 1/1999 Harris
5,951,419 A * 9/1999 Cameneti ..... F42B 6/06 473/586
6,179,736 B1 1/2001 Thurber
6,238,310 B1 * 5/2001 Morrison ..... F42B 6/04 473/581
6,454,623 B1 9/2002 Flatau
6,695,727 B1 * 2/2004 Kuhn ..... F42B 6/06 473/586
7,331,886 B2 2/2008 Morris et al.
7,909,714 B2 * 3/2011 Cyr ..... F42B 6/06 473/578
7,955,201 B2 * 6/2011 Harwath ..... F42B 6/04 473/578
8,465,384 B2 * 6/2013 Blosser ..... F42B 6/06 473/586
9,068,805 B2 * 6/2015 Owen ..... F42B 6/06
9,297,620 B2 * 3/2016 Boretto ..... F42B 33/001
9,410,776 B1 * 8/2016 Hill ..... F42B 6/06
9,448,046 B2 * 9/2016 Simo ..... F42B 6/06
9,631,908 B2 * 4/2017 Park ..... F42B 6/04
9,631,909 B2 * 4/2017 Boretto ..... F42B 6/04
9,863,743 B2 * 1/2018 Gall ..... F42B 6/06
9,945,646 B2 * 4/2018 Barnett ..... F41B 5/148
10,030,954 B2 * 7/2018 Brown ..... F42B 12/362
10,401,133 B1 * 9/2019 Sullivan ..... F42B 6/06
10,634,470 B2 * 4/2020 D'Acquisto ..... F42B 6/04
10,684,105 B2 * 6/2020 Hill ..... F42B 6/06
2003/0045381 A1 * 3/2003 Morris ..... F42B 10/12 473/578
2009/0291785 A1 * 11/2009 Smith ..... F42B 6/04 473/578
2014/0251295 A1 * 9/2014 Flint ..... F41B 11/723 124/25
2016/0377394 A1 * 12/2016 Boretto ..... F42B 6/04 473/578

* cited by examiner

ARROW WITH STABILIZING DEFLECTOR

CROSS-REFERENCE TO RELATED APPLICATIONS

This application claims the benefit of U.S. Patent Application No. 62/721,301, filed Aug. 22, 2018, the entire content of which is hereby incorporated herein by reference.

BACKGROUND OF THE INVENTION

This invention relates generally to archery and more specifically to arrow configurations.

Arrows are known in the art and generally include longitudinal fin-type stabilization members known as fletching. A fletch or vane typically has a height that extends radially outwardly from the arrow shaft to a radial height that exceeds a diameter of the shaft. A length of the fletch extends substantially longitudinally along a length of the shaft but is typically canted a few degrees to extend slightly helically about the shaft. During arrow flight, the helical configuration of the fletching spin stabilizes the arrow.

While fletching has benefits, it makes the arrows bulky, creating difficulty in storing, carrying and shooting the arrows. During aiming, an arrow is often supported by an arrow rest at a location forward of the fletching. When the arrow is fired, the fletching must transition across the arrow rest, and the bow and arrow rest are generally designed to accommodate the fletching.

The fletching also causes the arrow to include large side surfaces. Small amounts of crosswind during arrow flight can move an arrow off its desired course.

There remains a need for novel arrow configurations that remain accurate but reduce the downsides associated with traditional arrow fletching.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an arrow comprises a shaft, a nock and a deflector. The shaft comprises a cavity and the nock comprises a boss. The deflector surrounds the shaft and comprises a deflecting surface oriented at an angle to a surface of the shaft. The boss is positioned within the cavity and the deflector overlaps the boss.

In some embodiments, the deflector continuously surrounds the shaft.

In some embodiments, a radial height of the deflecting surface is less than a diameter of the shaft.

In some embodiments, the shaft comprises a shaft diameter and a diameter of the deflector is equal to or less than double the shaft diameter.

In some embodiments, the arrow excludes radial fletching.

In some embodiments, a deflector further comprises a declining surface.

In some embodiments, a deflector comprises vanes located behind the deflecting surface.

In some embodiments, arrow comprises a shaft and a nock. The shaft comprises a cylindrical portion and a flared portion. The flared portion comprises a deflecting surface oriented at an angle to a surface of the cylindrical portion.

In some embodiments, the flared portion further comprises a declining surface.

In some embodiments, the shaft further comprises a second flared portion comprising a second deflecting surface.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
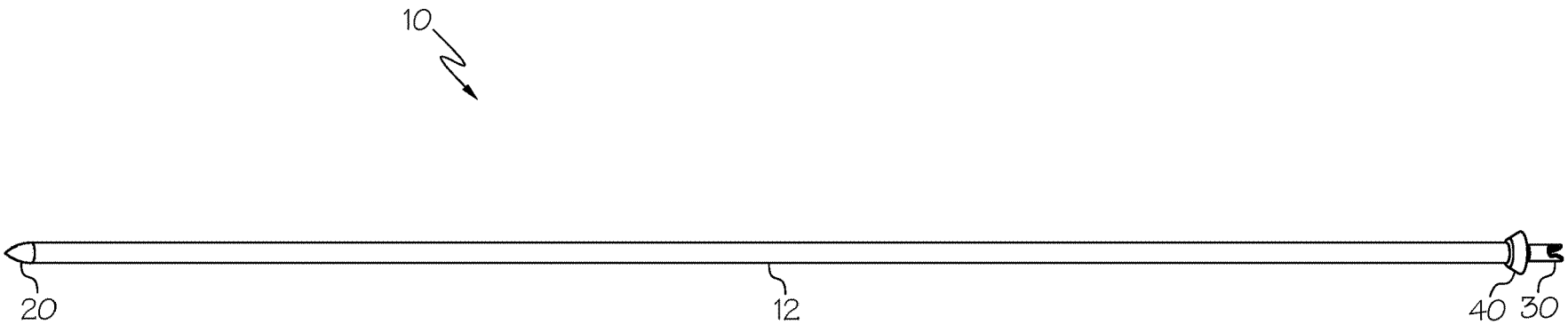
FIG. 1 shows an embodiment of an arrow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an arrow 10. In some embodiments, an arrow 10 comprises a shaft 12, a tip 20 and a nock 30. In some embodiments, an arrow 10 comprises a deflector 40. In some embodiments, a deflector 40 is located near the nock 30. In some embodiments, a deflector 40 contacts the nock 30. In some embodiments, the arrow 10 does not include traditional fletching or vanes. In some embodiments, the arrow 10 does not include any components that extend helically about the shaft 12. In some embodiments, the deflector 40 causes drag and stabilizes the arrow 10 during flight.

The shaft 12 can be made from any suitable material, such as carbon fiber, composites, aluminum, etc. In some embodiments, the shaft 12 comprises a tube. In some embodiments, the shaft 12 comprises a constant cross-sectional shape along its length. In some embodiments, the shaft 12 is substantially cylindrical. The tip 20 can comprise any suitable material and configuration as known in the art.

Figure 2:
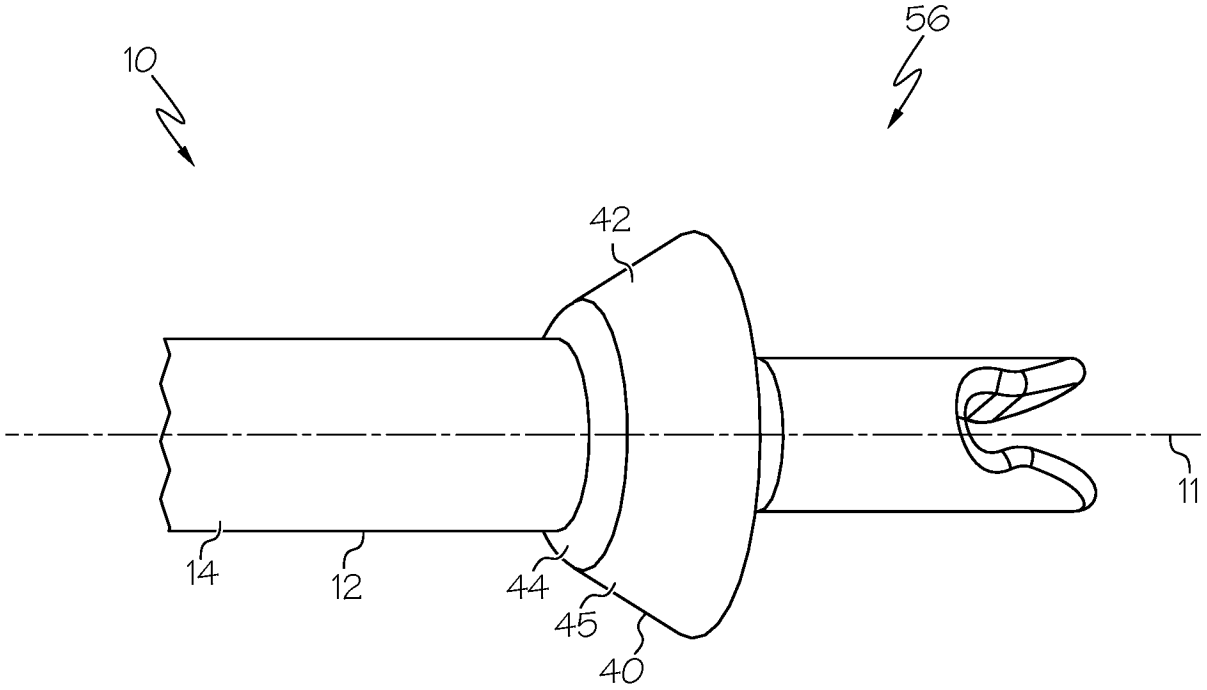
FIG. 2 shows a portion of the arrow of FIG. 1.
Figure 3:
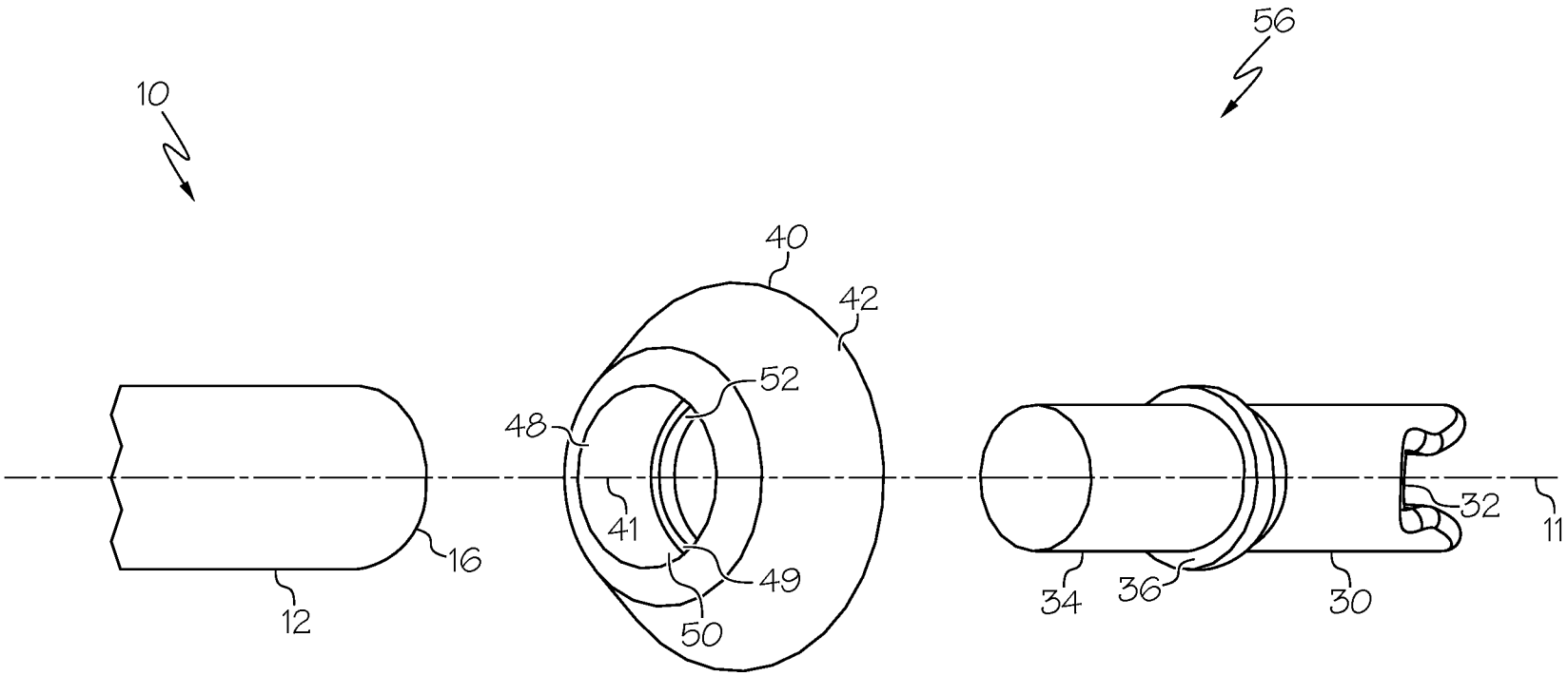
FIGS. 3 and 4 show exploded views of the arrow of FIG. 1.
Figure 4:
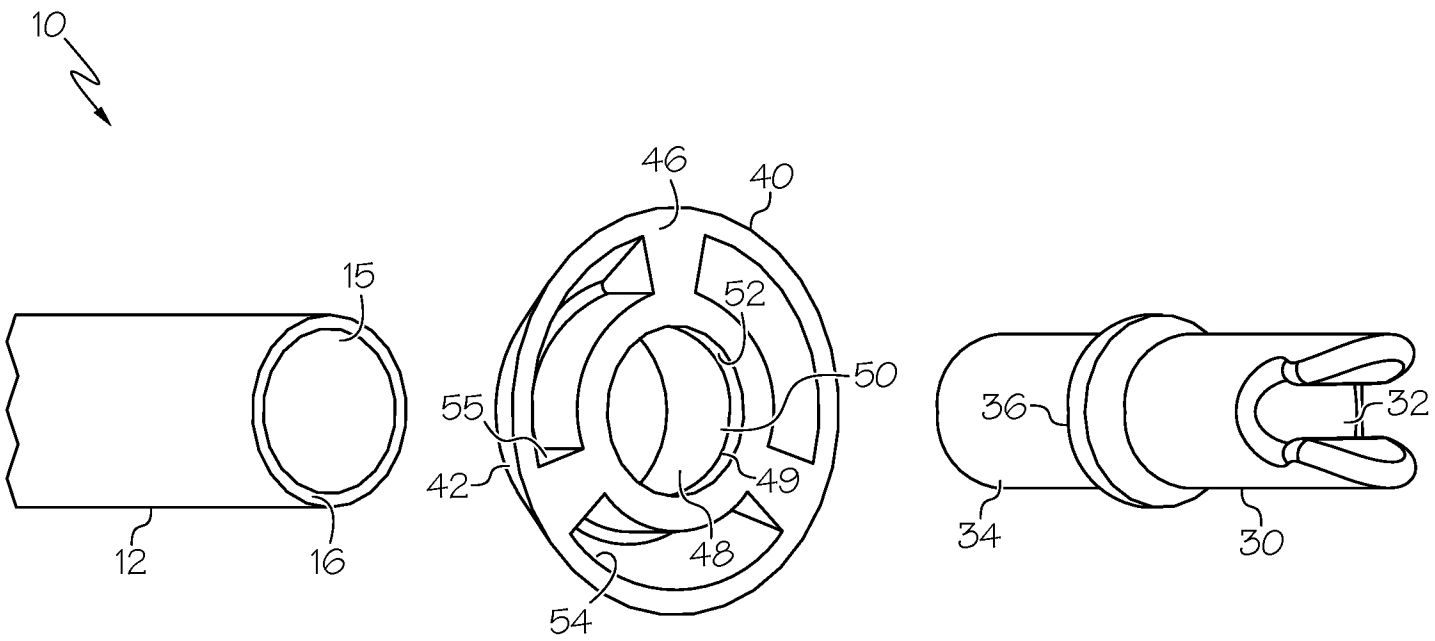

FIG. 2 shows the rear end portion 56 of the arrow 12 of FIG. 1 in greater detail, and FIGS. 3 and 4 show exploded views.

In some embodiments, a deflector 40 comprises a deflecting surface 42 that extends outwardly from an outer surface 14 of the shaft 12. In some embodiments, a radial distance from a longitudinal axis 11 of the arrow 10 to the deflecting surface 42 is greater than a radial distance from the longitudinal axis 11 to the outer surface of the shaft 12. In some embodiments, at least a portion of the deflecting surface 42 is oriented at a non-zero angle to the longitudinal axis 11 of the arrow 10. In some embodiments, at least a portion of the deflecting surface 42 is oriented at a non-zero angle to the outer surface 14 of the shaft 12.

In some embodiments, a deflector 40 comprises a ring that surrounds the longitudinal axis 11. In some embodiments, the deflector 40 defines a central axis 41 that is aligned upon the longitudinal axis 11. In some embodiments, the deflecting surface 42 extends continuously about the periphery of the deflector 40.

The deflecting surface 42 can have any suitable shape. In some embodiments, a deflecting surface 42 extends outwardly from the shaft 12 and is oriented at an angle to the longitudinal axis 11. In some embodiments, a deflecting surface 42 is oriented at an angle to the longitudinal axis 11 ranging from greater than 0 degrees to less than 90 degrees. In some embodiments, a deflecting surface 42 is oriented at an angle to the longitudinal axis 11 ranging from 10 degrees to 50 degrees. In some embodiments, a deflecting surface 42 is oriented at an angle to the longitudinal axis 11 ranging from 20 degrees to 40 degrees.

The deflecting surface 42 can span any suitable length portion of the arrow 10. In some embodiments, a span of the deflecting surface 42 along the longitudinal axis 11 is equal to or less than a diameter of the shaft 12. In some embodiments, a span of the deflecting surface 42 along the longitudinal axis 11 is equal to or less than half of the diameter of the shaft 12. In some embodiments, a span of the deflecting surface 42 along the longitudinal axis 11 is equal to or less than one-quarter of the diameter of the shaft 12.

The deflecting surface 42 can reach any suitable height above the outer surface of the shaft 12. Desirably, a distance across the deflecting surface 42 (e.g. diameter) is greater than a distance across the shaft 12. In some embodiments, a diameter of the deflecting surface 42 ranges from slightly greater than the diameter of the shaft 12 to twice the diameter of the shaft 12. In some embodiments, a diameter of the deflecting surface 42 ranges from 1.2 to 1.7 times the diameter of the shaft. In some embodiments, a diameter of the deflecting surface 42 is approximately 1.5 times the diameter of the shaft 12.

In some embodiments, the deflecting surface 42 forms an inclined surface with respect to the shaft 12. In some embodiments, the deflecting surface 42 comprises only inclined surfaces with respect to the shaft 12, and does not include any declining surface(s).

In some embodiments, the deflecting surface 42 comprises a frustum. In some embodiments, the deflecting surface 42 comprises complex curvature. In some embodiments, the deflecting surface 42 comprises a conical surface, a parabolic conical surface, an elliptical conical surface, etc., and various combinations thereof. In some embodiments, the deflecting surface 42 comprises a first portion 44 comprising a first geometry and a second portion 45 comprising a second geometry. In some embodiments, the first portion 44 and the second portion 45 are located sequentially along a length of the deflector 40.

In some embodiments, a deflector 40 comprises a cavity 48. In some embodiments, a portion of the shaft 12 is oriented in the cavity 48. In some embodiments, the deflector 40 comprises a stop 49. In some embodiments, a stop 49 comprises a flange surface that extends inwardly into the cavity 48. In some embodiments, an end 16 of the shaft 12 contacts the stop 49 when the shaft 12 is properly oriented with respect to the deflector 40.

In some embodiments, the cavity 48 of the deflector 40 comprises a central bore. In some embodiments, the cavity 48 comprises a first portion 50 and a second portion 52 having different sizes, for example having different diameters. In some embodiments, the first portion 50 is sized to receive the shaft 12, and a diameter of the first portion 50 is sized to contact an outer surface of the shaft 12. In some embodiments, a diameter of the second portion 52 is smaller than the outer diameter of the shaft 12. In some embodiments, a diameter of the second portion 52 is approximately equal to an inner diameter of the shaft 12.

Desirably, the nock 30 comprises a notch 32 arranged to engage a bowstring. In some embodiments, the nock 30 comprises a boss 34 and a flange 36. In some embodiments, the boss 34 is sized to contact an inner surface of the cavity 48 of the deflector 40. In some embodiments, the boss 34 is sized to contact an inner surface of the second portion 52 of the cavity 48. In some embodiments, the boss 34 is sized to contact an inner surface of the shaft 12. In some embodiments, the boss 34 extends through the cavity 48 of the deflector 40 and extends into a cavity 15 of the shaft 12. In some embodiments, the flange 36 contacts the deflector 40.

The components of an arrow 10 can be attached to one another using any suitable method. In some embodiments, the components are attached to one another using an adhesive, such as cyanoacrylate or other suitable adhesives. In some embodiments, the shaft 12 is bonded directly to the deflector 40 and bonded directly to the nock 30. In some embodiments, the nock 30 is also bonded directly to the deflector 40.

In some embodiments, the deflector 40 comprises a surface oriented orthogonal to the longitudinal axis 11. In some embodiments, a rear surface 46 of the deflector 40 is oriented orthogonal to the longitudinal axis 11.

In some embodiments, the deflector 40 comprises one or more cavities 54, which are provided primarily for weight reduction and/or efficient use of material. In some embodiments, the deflector 40 comprises one or more column members 55. In some embodiments, a column member 55 is oriented radially.

A deflector 40 can be made from any suitable material using any suitable process. In some embodiments, a deflector 40 comprises a relatively inelastic or non-elastomeric material that resists deformation. In some embodiments, a deflector 40 comprises a metal, wood, one or more polymers, reinforced composite polymers, etc. In some embodiments, a deflector 40 comprises a relatively elastic and deformable material such as rubber or an elastomeric polymer.

In some embodiments, a deflector 40 comprises a component that is separate and distinct from the shaft 12 and from the nock 30.

In some embodiments, a deflector 40 overlaps with the nock 30 along the length of the arrow 10. In some embodiments, a deflecting surface 42 overlaps with the nock 30 along the length of the arrow 10.

Figure 5:
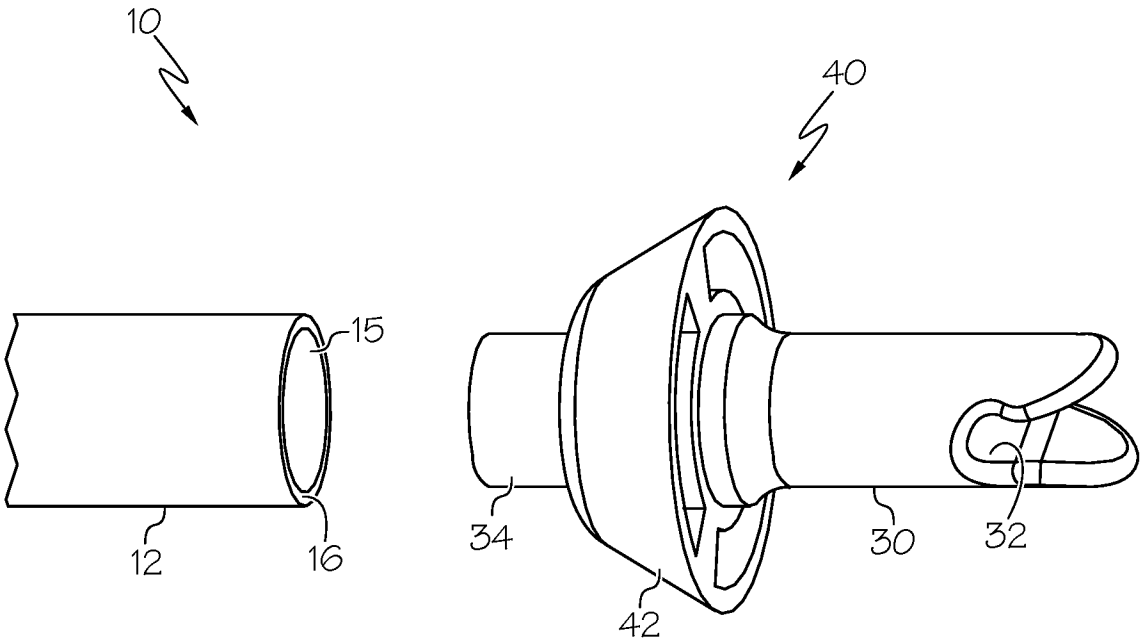
FIG. 5 shows an embodiment of a nock and arrow shaft.

FIG. 5 shows an alternative embodiment wherein the nock 30 and deflector 40 comprise a unitary piece. In some embodiments, the nock 30 comprises the deflecting surface 42.

In some embodiments, a nock 30 is formed from a single piece of material and comprises a notch 32, a boss 34 and a deflecting surface 42. The applicable features of the deflecting surface 42 as described above can be embodied in a nock 30. This arrangement can reduce the number of parts and reduce the complexity of assembling an arrow 10.

Figure 6:
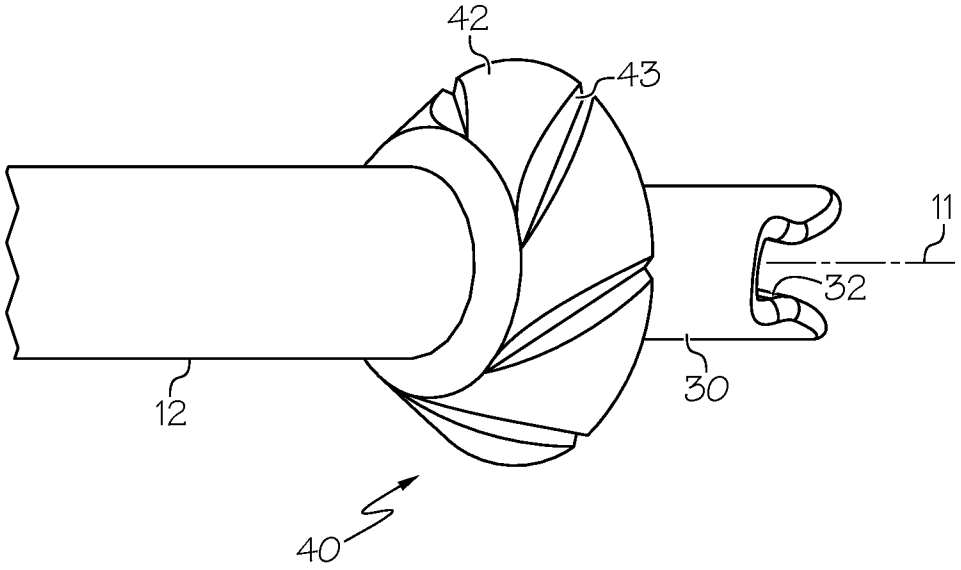
FIG. 6 shows another embodiment of an arrow.

FIG. 6 shows another embodiment comprising a deflector 40 comprising grooves 43 formed in the deflecting surface 42. In some embodiments, grooves 43 can be used to increase drag and/or provide rotational forces. In some embodiments, grooves 43 extend in a direction nonparallel to the longitudinal axis 11. In some embodiments, grooves 43 extend helically about the longitudinal axis 11.

Figure 7:
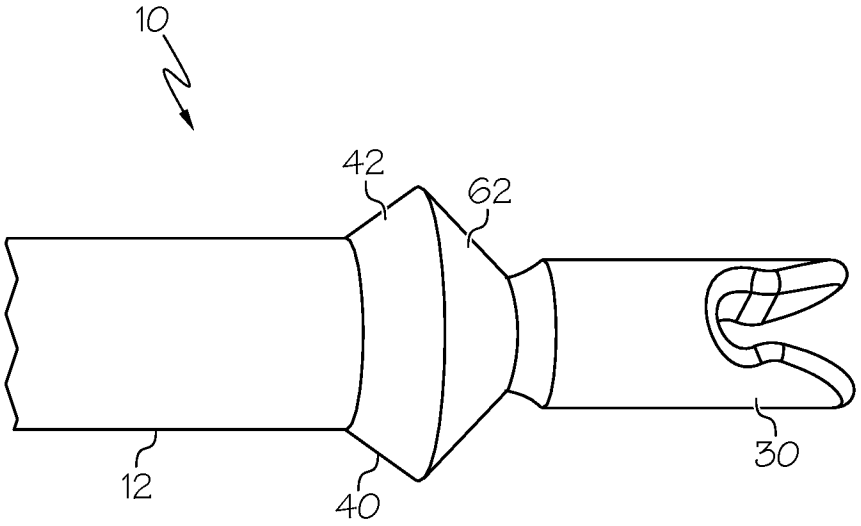
FIG. 7 shows another embodiment of an arrow.
Figure 8:
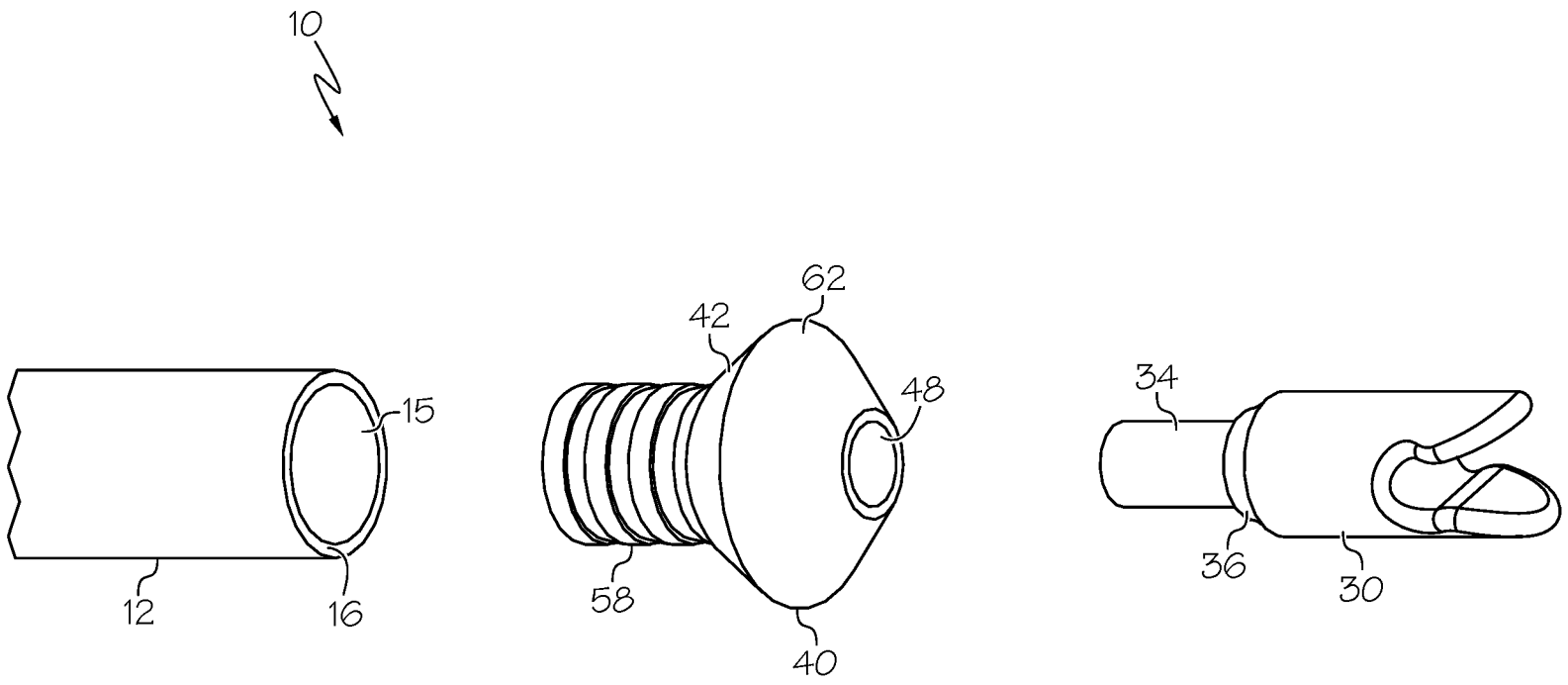
FIGS. 8 and 9 show exploded views of the arrow of FIG. 7.
Figure 9:
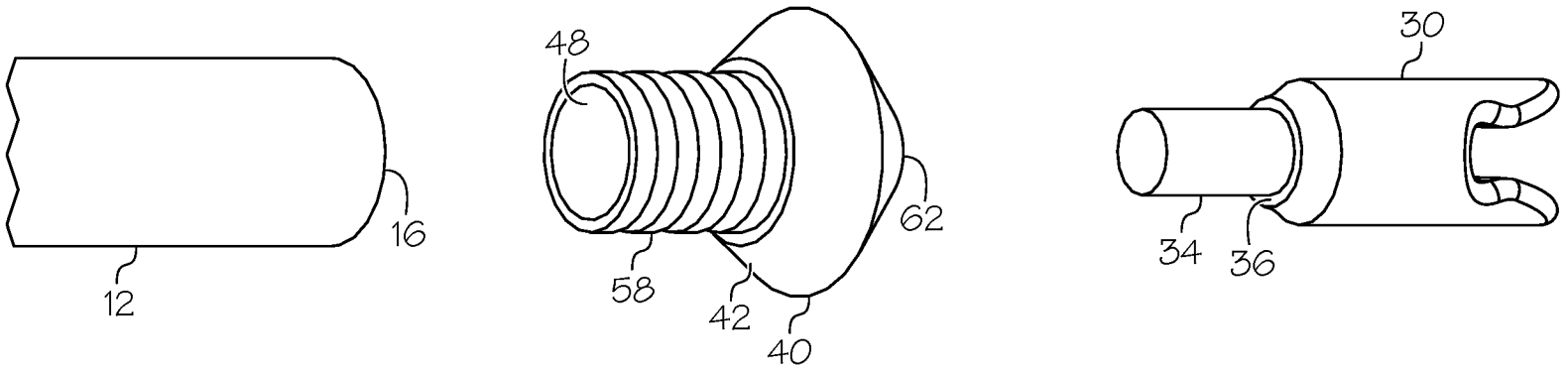

FIGS. 7-9 show another embodiment of an arrow 10 comprising a deflecting surface 42.

In some embodiments, a deflector 40 comprises a deflecting surface 42 that is inclined with respect to the shaft 12. In some embodiments, a deflector 40 comprises a declining surface 62 arranged to decline with respect to the shaft 12. In some embodiments, a deflecting surface 42 comprises a positive slope and a declining surface 62 comprises a negative slope. In some embodiments, the deflecting surface 42 transitions into the declining surface 62, and an outer surface of the deflector 40 is continuous across the transition. In some embodiments, the deflecting surface 42 and the declining surface 62 meet at an angle. In some embodiments, the transition from the deflecting surface 42 to the declining surface 62 comprises curvature and is gradual.

A declining surface 62 can comprise any suitable shape and have any suitable curvature.

In some embodiments, a deflector 40 comprises a boss 58. In some embodiments, the boss 58 is tubular and the cavity 48 extends through the boss 58. In some embodiments, the boss 58 of the deflector 40 is received in the cavity 15 of the shaft 12. In some embodiments, a boss 34 of the nock 30 is received in the cavity 48 of the deflector 40. In some embodiments, the boss 34 of the nock 30 is oriented within the cavity 48 within the tubular boss 58 of the deflector 40.

Figure 10:
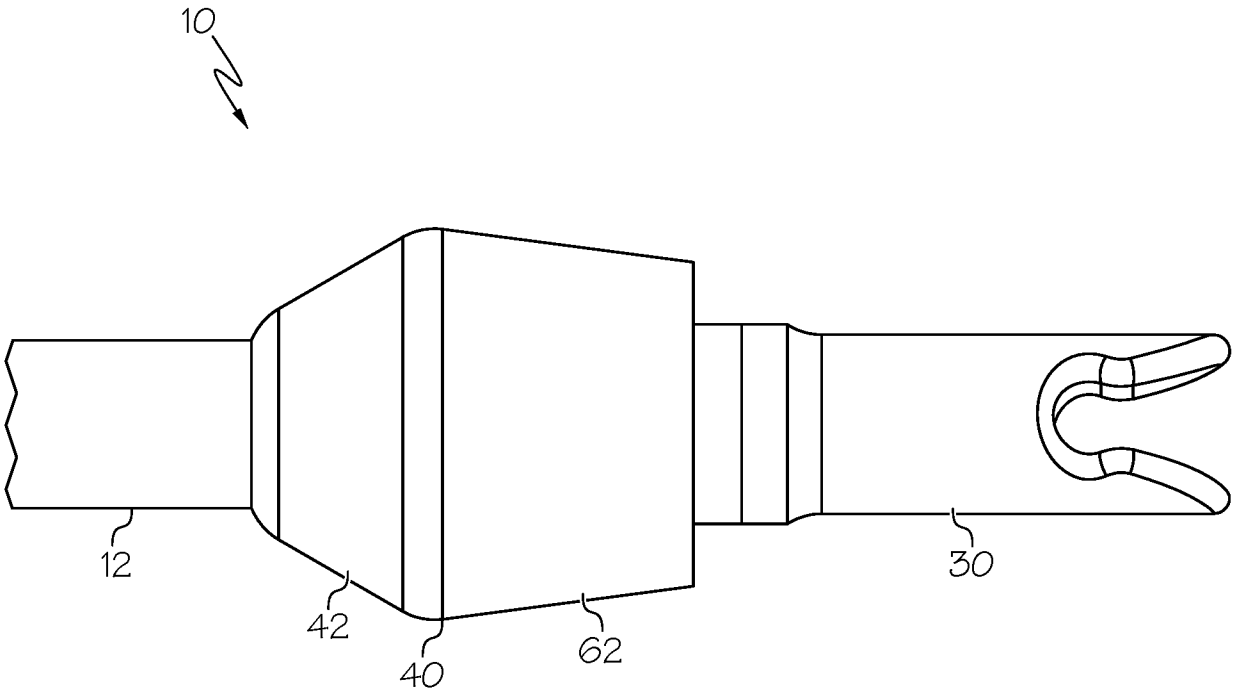
FIG. 10 shows another embodiment of an arrow.
Figure 11:
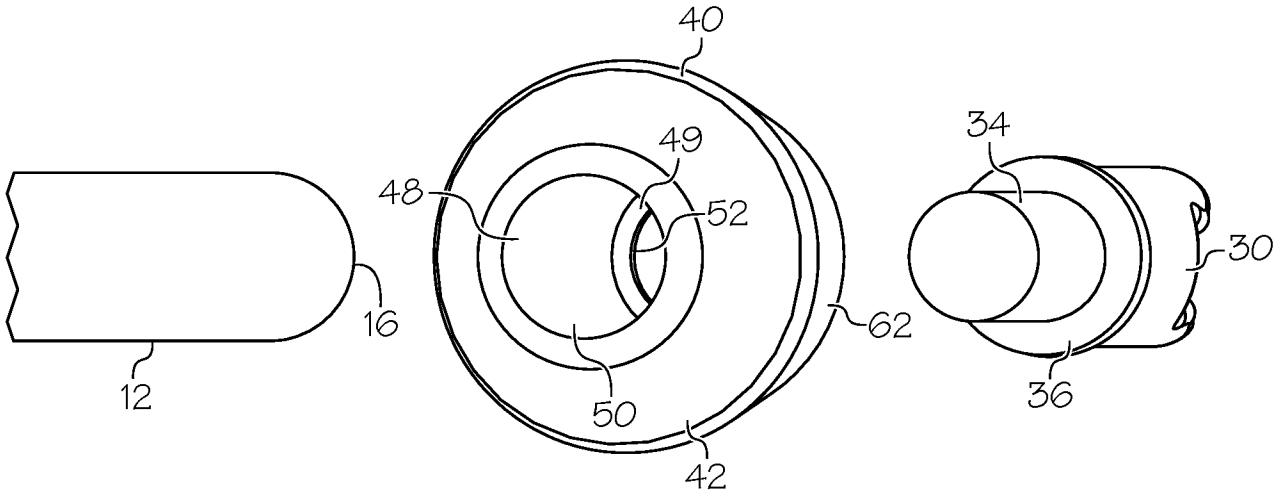
FIGS. 11 and 12 show exploded views of the arrow of FIG. 10.
Figure 12:
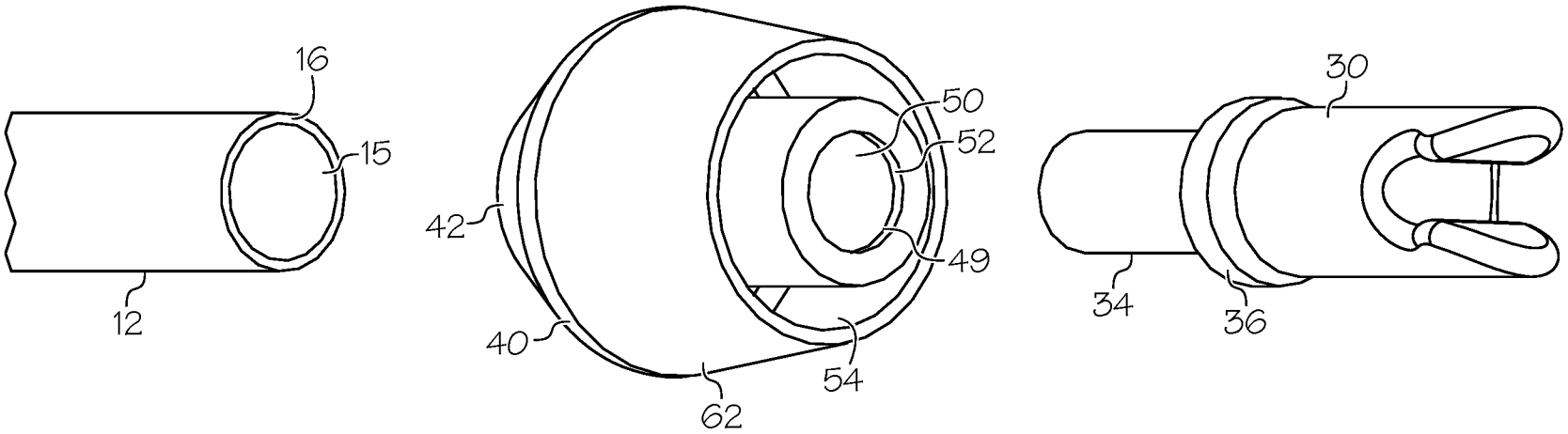

FIGS. 10-12 show another embodiment of an arrow 10 comprising a deflecting surface 42.

In some embodiments, a deflector 40 comprises a deflecting surface 42 and a declining surface 62. In some embodiments, the deflector 40 comprises a boat tail shape. The deflector 40 of FIGS. 11 and 12 includes features described herein, as indicated by similar reference characters.

Figure 13:
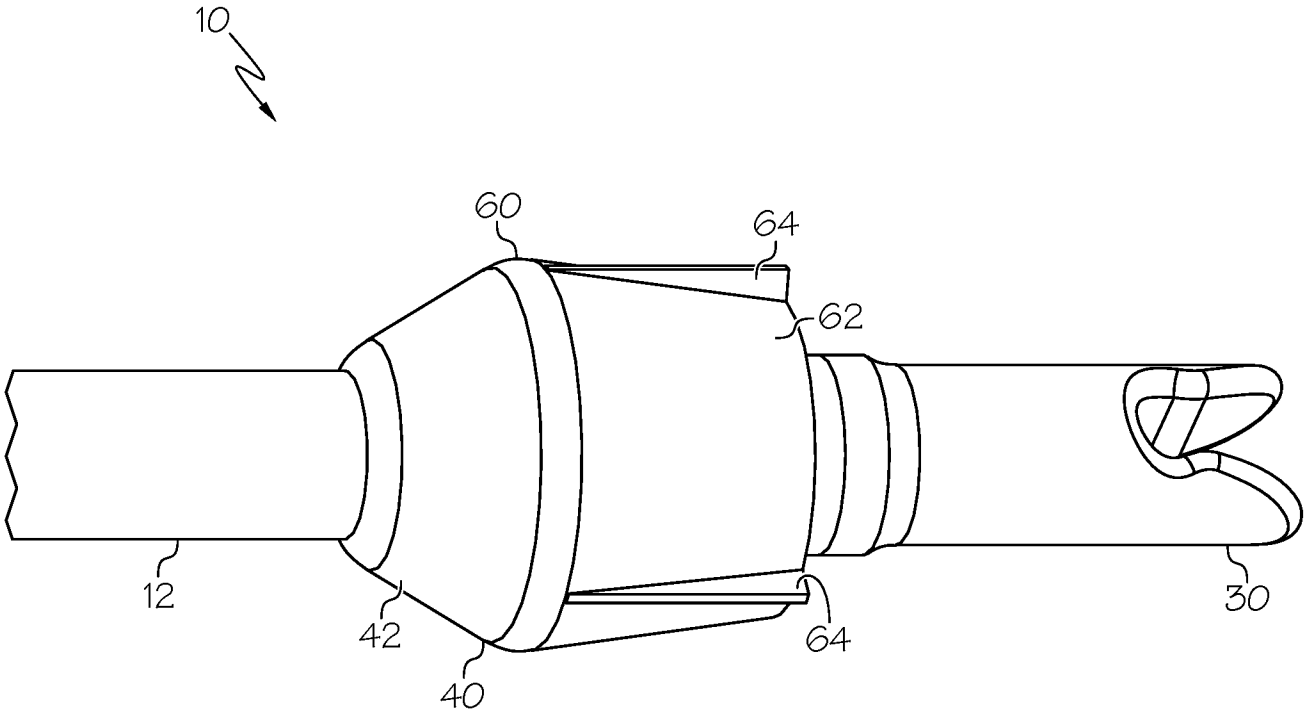
FIGS. 13 and 14 show views of another embodiment of an arrow.
Figure 14:
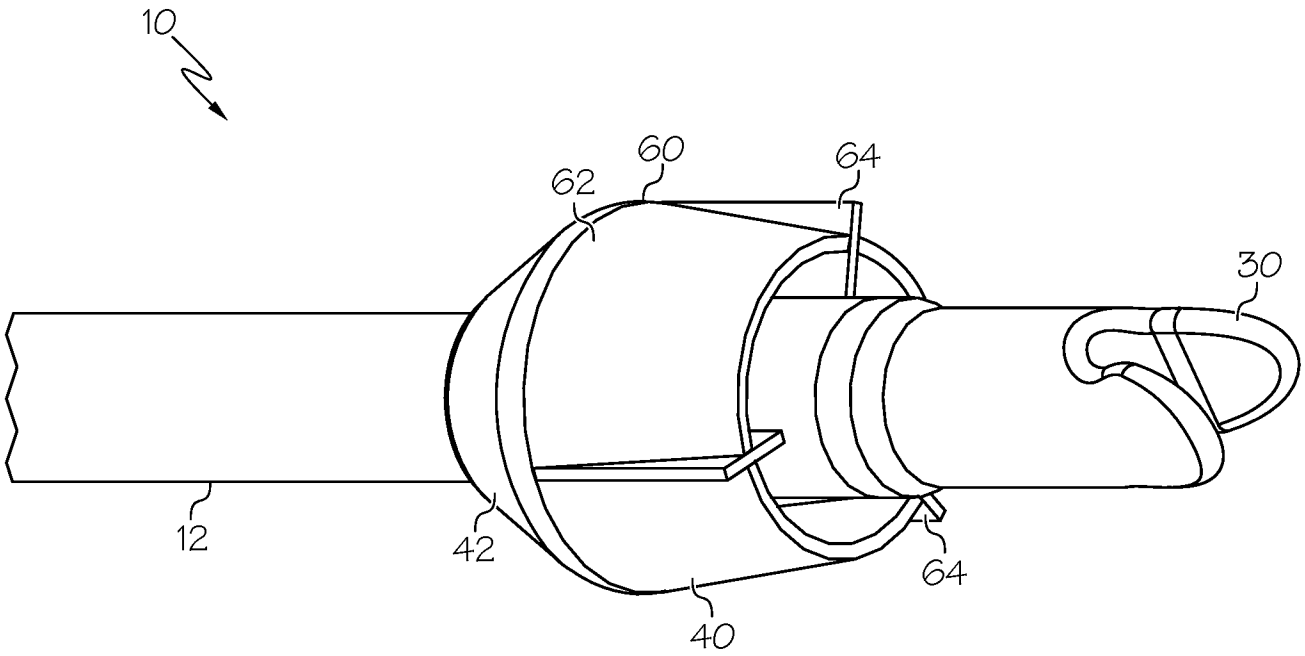

FIGS. 13 and 14 show another embodiment of an arrow 10 comprising a deflecting surface 42. In some embodiments, a deflector 40 comprises a deflecting surface 42 and a declining surface 62. In some embodiments, a deflector 40 comprises one or more vanes 64.

In some embodiments, the deflecting surface 42 extends away from the shaft 12 and forms a peak 60. At the peak 60, the deflecting surface 42 can transition to the declining surface 62. In some embodiments, one or more vanes 64 extend outwardly above the declining surface 62. In some embodiments, a radial height of a vane 64 is less than or equal to the largest radial height of the deflector 40.

In some embodiments, a plurality of vanes 62 are equally spaced about a periphery of the deflector 40.

Figure 15:
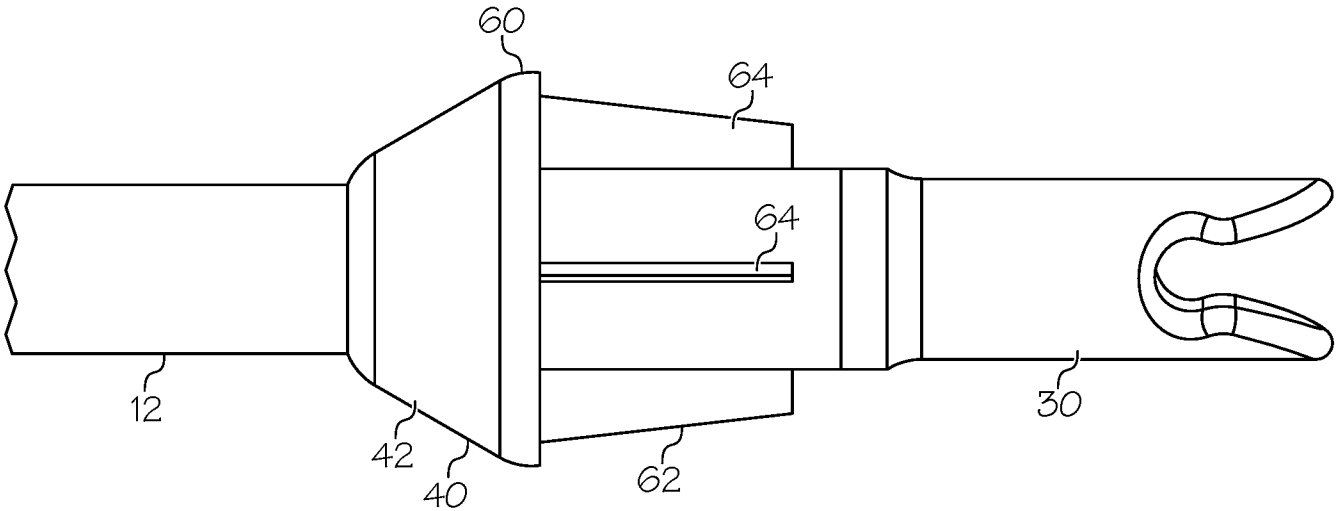
FIG. 15 shows another embodiment of an arrow.
Figure 16:
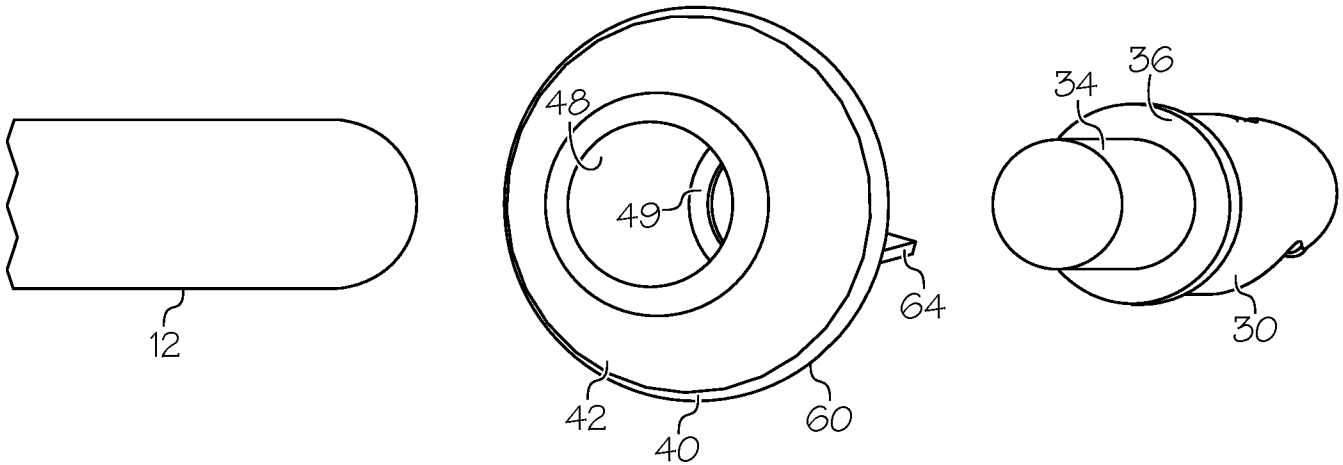
FIGS. 16 and 17 show exploded views of the arrow of FIG. 15.
Figure 17:
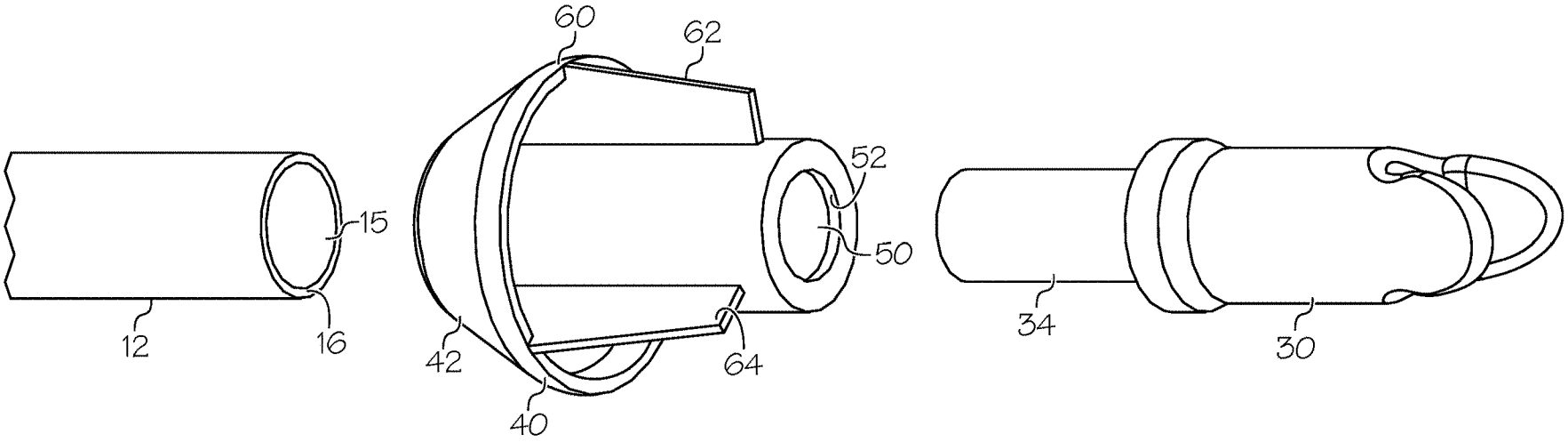

FIGS. 15-17 show another embodiment of an arrow 10 comprising a deflecting surface 42. In some embodiments, a deflector 40 comprises a deflecting surface 42 that extends continuously around the shaft 12 and reaches a peak 60, then transitions to a plurality of vanes 64 that are spaced around the shaft 12. In some embodiments, a vane 64 defines a declining surface 62.

Figure 18:
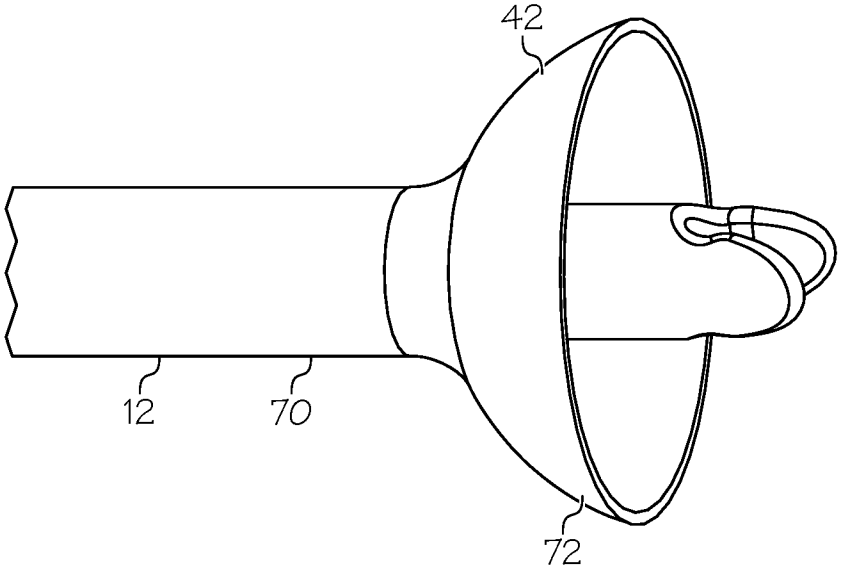
FIG. 18 shows another embodiment of an arrow.
Figure 19:
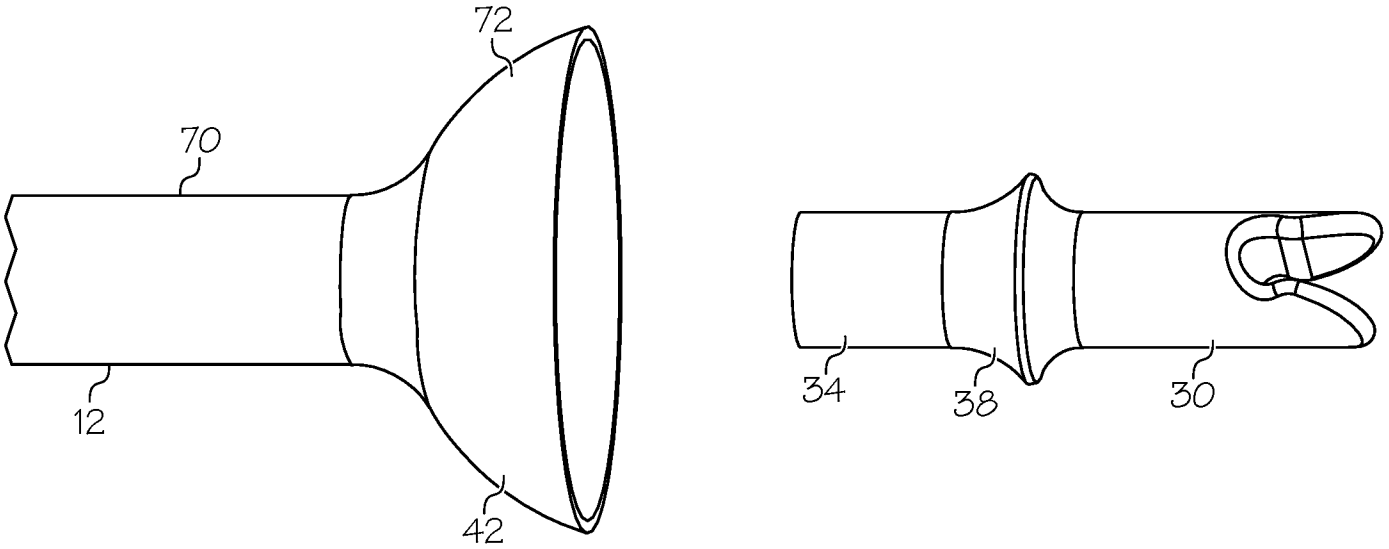
FIGS. 19 and 20 show exploded views of the arrow of FIG. 10.
Figure 20:
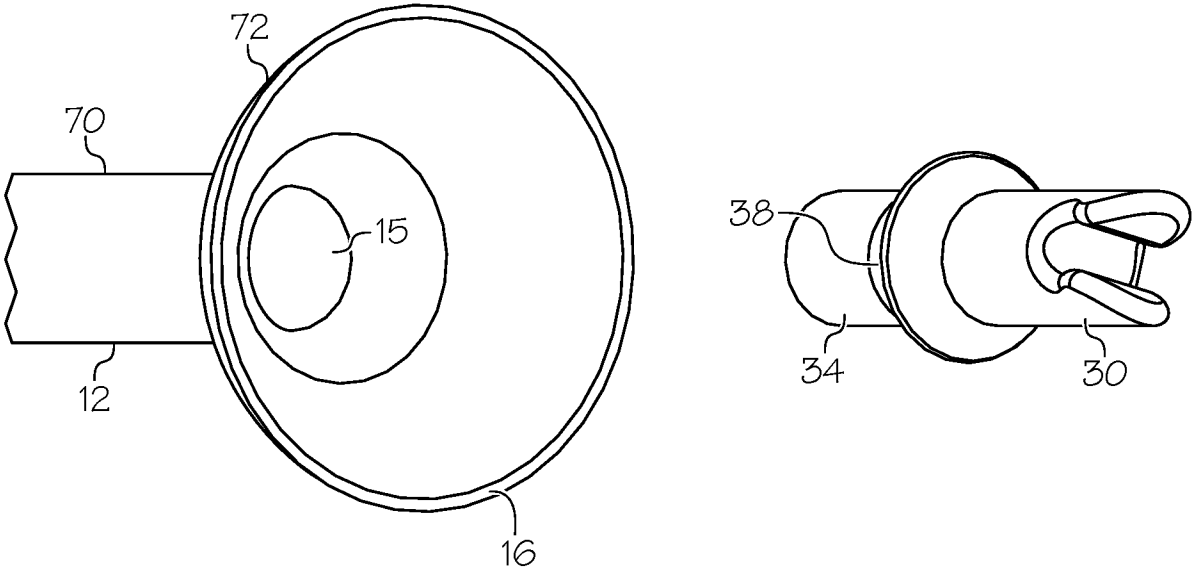

FIGS. 18-20 show another embodiment of an arrow 10 comprising a deflecting surface 42. In some embodiments, the shaft 12 comprises a deflecting surface 42. In some embodiments, a deflecting surface 42 is formed in the sidewall of the shaft 12. In some embodiments, the deflecting surface 42 is formed integrally with the shaft 12 material. In some embodiments, a diameter of the shaft 12 increases along the deflecting surface 42. In some embodiments, a thickness of the shaft 12 material does not change as the shaft 12 transitions from a substantially cylindrical portion 70 to a flared portion 72.

In some embodiments, a cavity 15 defined within the shaft 12 is flared, and the nock 30 comprises a flare 38 arranged to match the shaft 12. In some embodiments, the nock 30 comprises a boss 34 comprising a flare 38.

Figure 21:
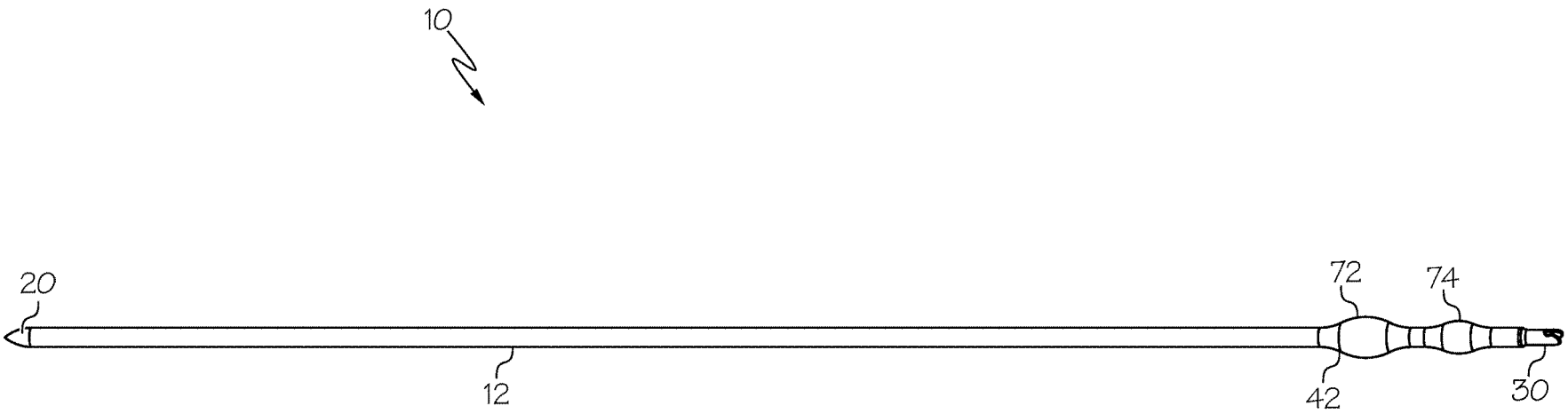
FIG. 21 shows another embodiment of an arrow.
Figure 22:
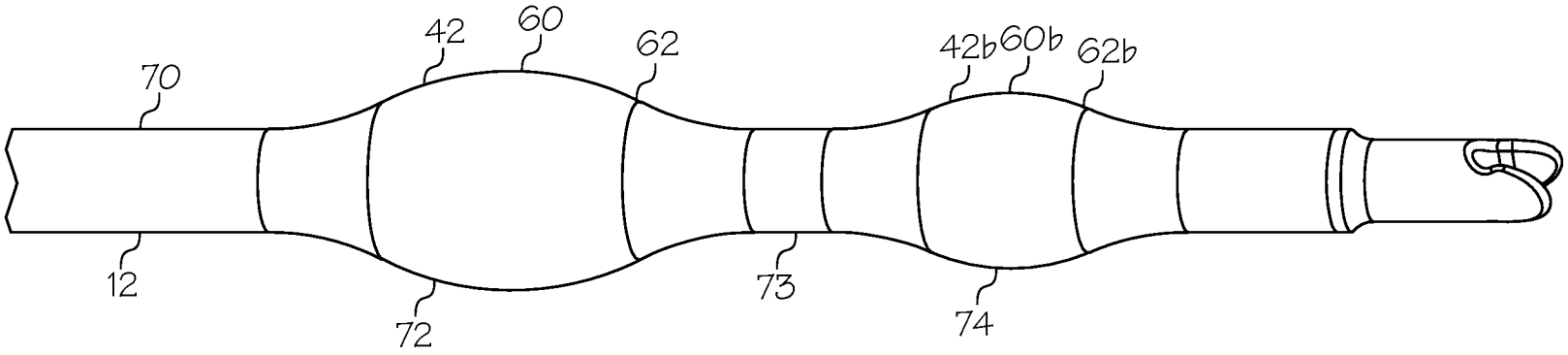
FIG. 22 shows a portion of the arrow of FIG. 21.
Figure 23:
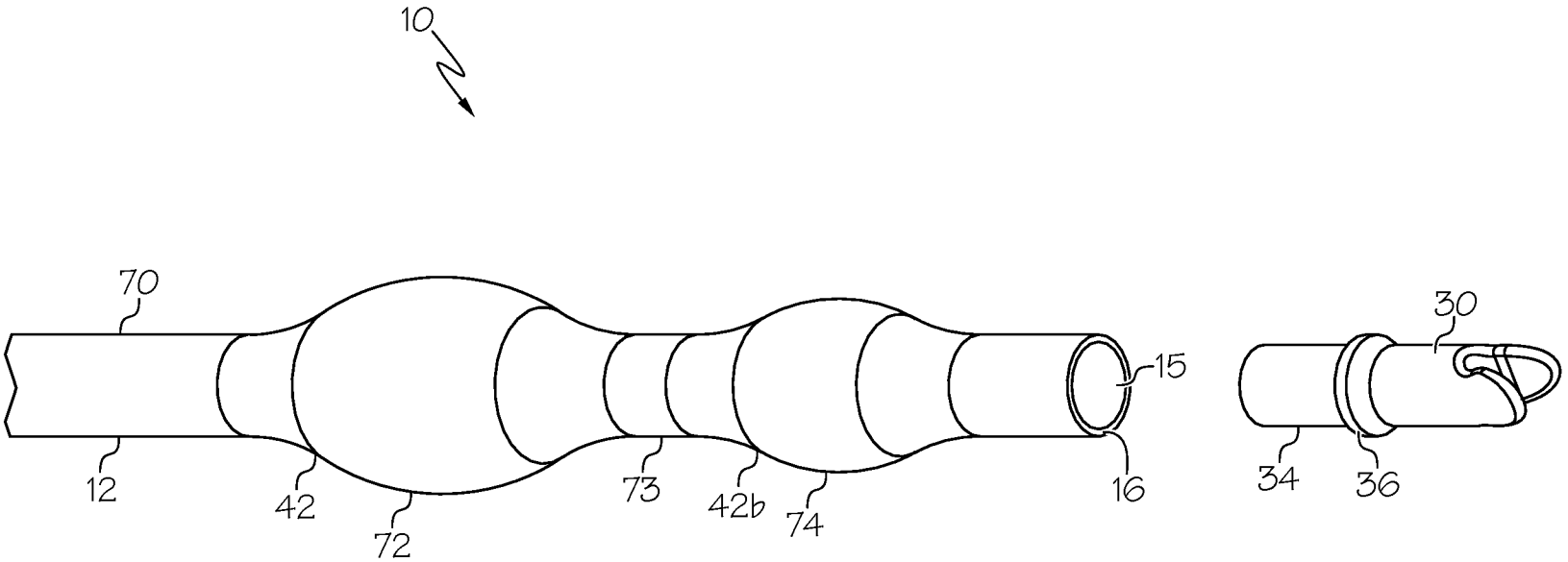
FIG. 23 shows an exploded view of the arrow of FIG. 21.

FIGS. 21-23 show another embodiment of an arrow 10 comprising a deflecting surface 42.

In some embodiments, an arrow 10 comprises a flared portion 72. In some embodiments, a flared portion 72 comprises a deflecting surface 42. In some embodiments, a flared portion 72 comprises a declining surface 62. In some embodiments, the flared portion 72 comprises a peak 60 located between the deflecting surface 42 and the declining surface 62. In some embodiments, the flared portion 72 is formed integrally in the shaft 12.

In some embodiments, an arrow 10 further comprises a second flared portion 74. In some embodiments, the second flared portion 74 comprises a second deflecting surface 42*b*. In some embodiments, the second flared portion 74 comprises a second declining surface 62*b*. In some embodiments, the second flared portion 74 comprises a peak 60*b* located between the second deflecting surface 42*b* and the second declining surface 62*b*. In some embodiments, the second flared portion 74 is formed integrally in the shaft 12.

In some embodiments, a first flared portion 72 is larger in size (e.g. diameter) than the second flared portion 74. In some embodiments, the first flared portion 72 comprises a diameter that is up to twice the diameter of the elongate shaft 12 cylindrical portion 70. In some embodiments, the second flared portion 74 comprises a diameter that is up to 1.5 times the diameter of the elongate shaft 12 cylindrical portion 70.

In some embodiments, the shaft 12 comprises an intermediate portion 73 located between the first flared portion 72 and the second flared portion 74. The intermediate portion 73 can have any suitable configuration and generally forms a restriction or narrowing between the flared portions 72, 74. In some embodiments, the intermediate portion 73 is cylindrical. In some embodiments, the intermediate portion 73 is sized similarly to the elongate shaft 12 cylindrical portion 70. In some embodiments, the intermediate portion 73 is larger (e.g. greater diameter) than the cylindrical portion 70.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An arrow comprising:

a shaft comprising a shaft cavity, the shaft comprising an outer sidewall and an end surface;

a nock comprising a boss; and a deflector surrounding the shaft, the deflector comprising a deflecting surface oriented at an angle to a surface of the shaft, the deflecting surface comprising a conical shape comprising a circular cross-sectional shape, the deflector comprising an outermost surface of the arrow, the deflector comprising a deflector cavity and a stop, the stop comprising a flange extending into the deflector cavity, the stop contacting the end surface;

wherein the boss is positioned within the shaft cavity and the deflecting surface overlaps the boss.

2. The arrow of claim 1, the deflector bonded to the shaft.

3. The arrow of claim 1, the nock contacting the stop.

4. The arrow of claim 1, the nock contacting the deflector.

5. The arrow of claim 1, the deflecting surface comprising a frustoconical portion.

6. The arrow of claim 1, the deflecting surface continuously surrounding the shaft.

7. The arrow of claim 1, wherein a radial height of the deflecting surface is less than a diameter of the shaft.

8. The arrow of claim 1, the shaft comprising a shaft diameter, wherein a diameter of the deflector is equal to or less than double the shaft diameter.

9. The arrow of claim 1, the angle between 30 degrees and 60 degrees.

10. The arrow of claim 1, the arrow excluding fletching.

11. The arrow of claim 1, the deflecting surface comprising an inclining surface, the deflector further comprising a declining surface.

12. The arrow of claim 11, the declining surface oriented between the deflecting surface and the nock.

13. The arrow of claim 1, the deflector further comprising a plurality of vanes.

14. The arrow of claim 13, a radial height of each vane being less than a radial height of the deflecting surface.

15. The arrow of claim 13, the plurality of vanes oriented between the deflecting surface and the nock.

16. An arrow comprising:

a shaft; and a nock;

the shaft comprising a cylindrical portion and a flared portion, the cylindrical portion integral to the shaft, the flared portion integral to the shaft, the flared portion comprising a deflecting surface, the deflecting surface oriented at an angle to a surface of the cylindrical portion, a radial height of the flared portion being greater than a radial height of the cylindrical portion, the deflecting surface comprising a conical shape comprising a circular cross-sectional shape, the flared portion comprising an outermost surface of the shaft.

17. The arrow of claim 16, the deflecting surface comprising an inclining surface, the flared portion further comprising a declining surface.

18. The arrow of claim 17, the flared portion comprising a first flared portion, the arrow further comprising a second flared portion comprising a second deflecting surface.

19. The arrow of claim 18, the second flared portion comprising a second declining surface.

20. The arrow of claim 18, the second flared portion comprising a size different from a size of the first flared portion.

* * * * *